United States Patent [19]

Kohler

[11] 4,287,649

[45] Sep. 8, 1981

[54] ROLLER CONSTRUCTION FOR PAPER FEEDING

[75] Inventor: Henry A. Kohler, Orchard Park, N.Y.

[73] Assignee: Truly Magic Products, Inc., Buffalo, N.Y.

[21] Appl. No.: 130,145

[22] Filed: Mar. 13, 1980

Related U.S. Application Data

[63] Continuation of Ser. No. 930,933, Aug. 4, 1978, abandoned.

[51] Int. Cl.[3] ..... B05C 11/02

[52] U.S. Cl. ..... 29/130

[58] Field of Search ..... 29/121.1, 129.5, 130, 29/132

[56] References Cited

U.S. PATENT DOCUMENTS

| | | | |
|---|---|---|---|
| 2,097,315 | 10/1937 | Watkins | 29/130 |
| 2,844,370 | 7/1958 | Thomas | 271/42 |
| 2,886,156 | 5/1959 | Halbron | 193/37 |
| 2,894,744 | 7/1959 | Schultz | 271/51 |
| 3,622,059 | 11/1971 | Savela | 271/51 X |
| 3,788,638 | 1/1974 | Lehman | 271/51 |
| 3,866,572 | 2/1975 | Gundlach | 29/132 X |
| 3,950,833 | 4/1976 | Adams | 29/132 |
| 3,955,342 | 5/1976 | Vohnson et al. | 29/132 X |
| 4,061,109 | 12/1977 | Allen | 29/121.1 X |

FOREIGN PATENT DOCUMENTS

| | | | |
|---|---|---|---|
| 288851 | 1/1967 | Australia | 29/132 |

*Primary Examiner*—Werner H. Schroeder

*Attorney, Agent, or Firm*—Joseph P. Gastel

[57] ABSTRACT

A paper feeding roller construction including a core of foamed cellular resilient material which has a shore hardness which is not measurable to thereby provide extremely easy compressibility, and an annular skin of a relatively hard elastic material on the core for providing toughness and abrasion-resistance, with the annular skin being coated onto the core so as to retain the cellular structure thereof on its surface to provide air pockets.

18 Claims, 9 Drawing Figures

10
11
12
13
14
15
16
17
19
20
21
22
23
24
25
26
27
29
30
30'
31
32
33
34
11'
14'
10'
2
3
4
R
r
X
a
b

ROLLER CONSTRUCTION FOR PAPER FEEDING

This is a continuation of application Ser. No. 930,933, filed on Aug. 4, 1978, now abandoned.

BACKGROUND OF THE INVENTION

The present invention relates to an improved roller construction for feeding paper in various types of machines, such as copiers, calculators, printers, computers and wherever else paper feeding functions are required.

By way of background, in the past relatively hard rubber rollers were utilized for paper feeding functions in various types of machines. These rollers were subject to certain shortcomings. In this respect, the rollers were relatively expensive to fabricate in that precision cutting and finishing procedures were required to make certain that the rollers were not out-of-round, as this could cause skewing of the paper being fed, or could cause extremely high pressure points on the paper, which could result in the tearing thereof. In addition, because of the relative incompressibility and inflexibility of prior art rollers, the surfaces thereof became glazed because of the retention of paper particles and the polishing action resulting in slippage between the rollers and the paper. This in turn resulted in defective paper feeding after a period of use, which in turn resulted in the necessity to either refurbish or replace the rollers. It is with the overcoming of the foregoing deficiencies of prior relatively hard paper feeding rollers that the present invention is concerned.

SUMMARY OF THE INVENTION

It is accordingly one important object of the present invention to provide an improved paper feeding roller which is extremely soft so that it can compress and flex to accommodate itself to the surface of the paper being fed even though it may not be perfectly cylindrical, thereby obviating the expense required to make rollers perfectly cylindrical.

Another object of the invention is to provide an improved paper feeding roller which is not only soft so that it can accommodate itself to the surface of paper being fed, but which also has a relatively tough abrasion-resistant skin so that it will provide high resistance to wear.

A further object of the present invention is to provide an improved paper feeding roller having a cellular structure on the outer surface thereof which provides the advantages of a good tread for gripping paper, and which, in combination with the flexibility and compressibility of the roller, provides a self-cleaning action to flick foreign particles from the surface of the roller, thereby obviating the glazing which results from their retention.

Yet another object of the present invention is to provide an improved paper feeding roller which will provide a good paper feeding action when the paper can be moved but which, because of its easy compressibility, will be able to rotate while in contact with the paper without feeding it, and further, because of its self-cleaning action, will not become glazed. Other objects and attendant advantages of the present invention will readily be perceived hereafter.

The present invention relates to a paper feeding roller construction comprising a core of extremely soft resilient material and an annular skin of relatively hard flexible material formed integrally with said core. Preferably the core is fabricated from foamed cellular resilient material, with the annular skin being coated onto the core so that the surface thereof includes depressions formed by the contour of a cellular structure. The core is also preferably open cell foamed resilient material which interlocks with the annular skin. The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5, 6, 7, 8, 9:
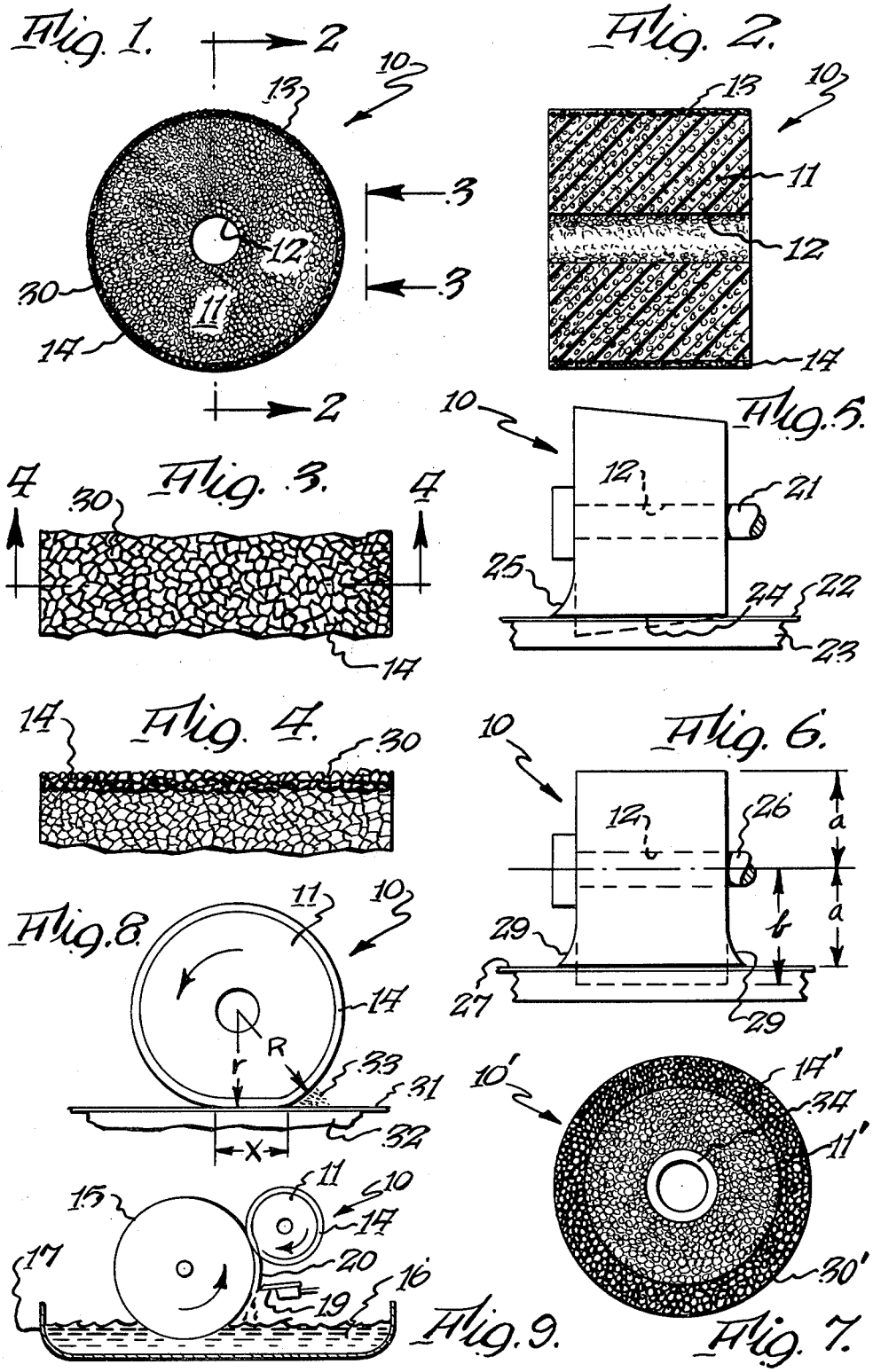
FIG. 1 is a side elevational view of one form of the improved roller of the present invention.
FIG. 2 is a cross sectional view taken substantially along line 2—2 of FIG. 1.
FIG. 3 is a fragmentary enlarged view of the surface of the roller taken substantially in the direction of arrows 3—3 of FIG. 1.
FIG. 4 is an enlarged fragmentary cross sectional view taken substantially along line 4—4 of FIG. 3.
FIG. 5 is an end elevational view of a roller, such as shown in FIG. 1, but which is imperfect in that it is in the shape of a truncated cone, and showing how the softness of the roller permits it to conform to a planar surface.
FIG. 6 is a view similar to FIG. 5 but showing a roller of the type shown in FIG. 1 but which is imperfect in that the shaft which mounts it is off-center, and also showing how the softness of the roller permits it to adapt to rolling on a planar surface while maintaining substantially constant pressure regardless of its being mounted off-center.
FIG. 7 is a side elevational view of an alternate embodiment of roller made in accordance with the principles of the present invention.
FIG. 8 is a fragmentary side elevational view of the roller in action showing how the resilience in combination with the air pockets in the surface causes foreign material to be shed from the roller during operation.
FIG. 9 is a fragmentary schematic view showing how the improved roller of the present invention may be fabricated.

The improved roller 10 includes a core or body 11 of foamed cellular elastic material which has been cut to have a central shaft receiving opening 12 and an outer cylindrical surface 13. While the core 11 is preferably made of polyurethane foam, it can also be fabricated of rubber sponge, esters, or ethers, or any other plastic material having elastic characteristics which can be made into a cellular foam. The cell structure may be open or closed, that is, the cells of body 11 may be in communication with each other or may be isolated from each other by the matrix of material. However, open cell foam is preferred because this characteristic will enable it to soak up the solution which is applied to it as an outer skin 14, as described hereafter. One of the main criteria of body 11 is that it should be so soft that it has substantially a zero Durometer reading, or it should at least be very soft. The cellular foam may have any desired density range which will give the foregoing characteristic, and such range may be anywhere between 1.2 pounds per cubic foot to 18 pounds per cubic foot. Under certain circumstances it may be possible to use a core or body 11 which is solid and not cellular, but such a core would not have the softness of a cellular structure, the softness of which depends on the combined elasticity of the matrix with air bubbles therein.

An annular skin 14 is applied to body 11. As can be seen from FIG. 9, one way of applying skin 14 is by a roller coating action wherein a roller 15 picks up liquid coating material 16 from tray 17 and carries it to doctor knife 19 which is spaced from roller 15 a predetermined distance to leave only a certain thickness of material 20 on roller 15 which is transferred to roller body 11. By this process the thickness of skin 14 can be controlled. Skin 14 is preferably a polyurethane polymer which can be applied to a thickness of anywhere between 0.005 inches to 3/32 of an inch or greater. The roller coating process provides a very even coating to roller body 11, thereby obviating any necessity for any trimming of the completed roller. A suitable polyurethane polymer which has been used is known under the trademark TRANCO and it has an identification number of MC-245. It will be appreciated that an extremely stable and solid roller 10 is produced by the foregoing process in view of the fact that the solvent for skin 14 is also a solvent for body 11 so that the application of the solvent-containing coating to the outer surface of body 11 causes excellent adhesion between the core and the skin. As noted above, open celled polyurethane foam is preferred for core 11 because the coating will penetrate the outer annular portion of the core 11 and the skin 14 will become mechanically bonded to and interlocked with the fibers of the core.

It will be appreciated that the skin 14 may be applied by methods other than roll coating, such as by spray coating or in any other suitable manner which will provide the desired skin structure on the surface of the roller as described hereafter. The skin is put on as a liquid and it hardens after application. No curing or subsequent fabricating processes are necessary. It will also be appreciated that the skin may have any desired hardness characteristic, or can be applied to any desired thickness, or it may have any desired coefficient of friction, or any desired elasticity. The hardness and stiffness of the rollers can be controlled by suitable selection of the thickness and hardness of the skin 14. In addition, it may be any suitable material other than polyurethane which can be applied to the core 11 and which will adhere thereto.

The basic characteristics of improved roller 10 are that it is extremely soft so that it can flex, as described hereafter, and it also possesses excellent abrasion-resistance because of the tough skin 14. The softness of core 11 permits the dimensioning and concentricity of the roller 10 to be inexact, and it will still provide good paper feeding.

In FIG. 5 a roller 10 is shown which is not exactly cylindrical, that is, it has been fabricated out-of-round in the form of a truncated cone. Roller 10 is mounted on shaft 21 which extends through bore 12. Roller 10 bears against a sheet of paper 22 which is supported on planar surface 22. Notwithstanding the uncylindrical shape of roller 10, the surface 24 of the roller which bears against paper 22 is in good full-face contact with the paper because the softness of the core 11 of roller 10 permits the roller to flex from its normal dotted-line configuration and bulge at 25 to thereby permit the desired contact with paper 22. Because of the softness, there will be no skewing of the paper. An action of this type is impossible with a harder roller, which would only engage the paper with a portion of its surface and not across the entire width thereof, as shown in FIG. 5.

In FIG. 6 there is shown a roller 10 mounted off-center on a shaft 26. The broken lines show the roller in its unstressed condition. The bore 12 is off-center so that radius a is smaller than radius b. However, the surface of the paper 27 being fed is only radius a distance away from shaft 26. Therefore, because of the softness of the core of roller 10, it can compress to assume the solid-line shape shown in FIG. 6, when the portion of radius b engages the paper. In this respect, the sides will bulge at 29 but the amount of pressure between the roller 10 and the surface of the paper even when the portion of radius b is engaging it will be substantially the same as when the portion of radius a is engaging it, and this phenomenon is due to the softness of the core material 11.

The foregoing softness characteristics of the rollers, as described relative to FIGS. 5 and 6, can be all the more appreciated when it is considered that a hard rubber roll, of the type heretofore used, needs precise dimensions in both its diameter and concentricity to make it practical, that is, to give it a uniform feeding characteristic. If the prior art roller was not precisely dimensioned and concentric, it would have produced erratic feeding or tearing, that is, it might have borne too hard in certain locations, or it might have missed the paper. As noted above, the improved roller 10 of the present invention is not subject to the foregoing shortcomings. In addition, the precision required for fabricating prior art hard rubber rolls caused them to be relatively expensive. However, the flexibility and adaptability of the improved rollers of the present invention permits a greater manufacturing tolerance and therefore permits them to be fabricated at a lower cost, while still providing excellent operational characteristics.

The precision ground relatively hard rubber rolls of the prior art were applied against the paper being fed with a relatively light pressure. Under certain circumstances this caused slippage between the paper and the rollers. This in turn caused glazing of the surface of the rollers because of the abrasive characteristics of the paper, which, in turn, caused the rollers to lose their feeding ability. The feeding ability was also reduced because the rollers picked up proper fibers which functioned as a lubricant. In contrast to the foregoing, the improved rollers of the present invention can be pressed against the paper being fed with sufficient force so that the surface of the roller contacting the paper is in a relatively large area of contact with the paper. In other words, the "flat" of the roller is relatively large compared with the amount of surface of a harder rubber roller in contact with the paper. Stated otherwise, the improved roller of the present invention gives a rectangular area of good contact with the paper being fed, whereas the hard rollers of the prior art maintained substantially only line contact with the paper. Thus, the improved roller 10 of the present invention is capable of providing precise paper feeding because it maintains a relatively large surface of contact with the paper without subjecting the paper to excessive roller pressure.

The improved roller 10 produces improved feeding characteristics because the surface 30 of skin 14 is essentially porous. In this respect, because of the manner in which the skin 14 is applied, as described above relative to FIG. 9, the coating follows the contour of the cellular structure. The cellular structure is visible from the surface of the roller, as depicted by FIGS. 3 and 4.

Thus, a rough surface is provided which is in the nature of a tread so that there can be good engagement of the paper for feeding purposes. In other words, the surface of skin 14 will have hills and valleys which essentially follow the contour of the surface of core 11. This is generally the case when the thickness of skin 14 is below a predetermined value.

The foregoing structure of skin 14 provides a plurality of advantages. One of these advantages is a self-cleaning action. In this respect, for example, in FIG. 8 a sheet of paper 31 is being fed along surface 32. Roller 10 bears against paper 31 in the zone X. During this bearing action, particles of paper may enter the depressions in skin 14. Also, it is to be noted that at this time roller 10, when operating in zone X, has a radius of substantially r because it is forced to a flattened condition in this area. However, after the roller 10 leaves paper 31, it expands to its normal larger radius R. It is believed that the expansion of the size of roller 10 from radius r to radius R causes a flicking action which flicks off particles of paper 33, and thus roller 10 possesses a self-cleaning action. It is believed that the flicking action is aided by the fact that there is a certain amount of air in the surface pores which acts as a lubricant and as a barrier for preventing foreign paper particles from adhering to the surface of skin 14. At this point it is to be noted that any desired concentration of pores can be used to obtain the foregoing action, and such concentration, or pattern, may be anywhere between 10 pores per linear inch to 100 pores per linear inch, measured along the circumference of the roller. For certain applications it may be desirable to depart from the foregoing parameters, depending on the size of the rollers and the purposes for which they are being used. At this present time it might be mentioned that the rollers described heretofore have a diameter of between ½ inch and about 2 inches. However, it will be appreciated that for rollers having greater diameters, it may be desirable to have less pores per linear inch than the 10 pores per linear inch mentioned above.

Another characteristic of the porous surface of a roller such as 10 is that the cells on the surface of the rollers will accept air and therefore there will be no "planing" action, that is, an action where the roller runs on a layer of air between the surface of the roller and the paper being fed. In other words, as noted above, it is believed that the cellular surface structure of the roller, by accepting air, obviates planing. At this point it is to be noted that there are certain times that the roller 10 must rotate relative to the paper while the paper is being held. Under these circumstances it is believed that the ability of the cellular structure to receive air produces an air cushion which acts somewhat in the nature of a lubricant to permit slippage.

Thus, there are two somewhat contradictory actions produced by the outer cellular structure, that is, (1) the trapping of air in the cells prevents "planing" when the paper is being fed, and (2) the cellular structure, by accepting air, permits relative slippage between the roller and the paper when the latter is being held because of the fact that the air pockets act as a lubricant. Furthermore, the softness of the core 11 permits the roller 10 to yield when the paper is being held so that there can be slippage without deleterious effects either resulting in the tearing of the paper or the ruining of the roller by glazing it. It is again to be especially noted that when the roller 10 slips relative to paper which is being held, the tendency for glazing of the roller by picking up foreign paper particles is obviated because the roller flicks the paper particles therefrom as described above relative to FIG. 8.

An alternate embodiment of the present invention is shown in FIG. 7 wherein roller 10' includes a foamed cellular core 11' mounted on a cylindrical annular metal hub 34 which receives a shaft (not shown). Otherwise roller 10' is the same as previous embodiments. The skin 14' of roller 7 is relatively thick. In fact, it may be so thick that the cellular structure of core 11' may not be retained on the outer surface 30'. The core 11' is open cell foam, and the outer skin 14' fills the cells on the periphery of body 11' to provide an outer skin which is interlocked with the core; whereas in closed cell cores the skin essentially stays on the surface. The skin 11' may still be relatively thick while the cellular structure is retained on the outer periphery, this being due to the fact that the outer skin is absorbed by the open cells of the foam, and the resulting skin at its extreme outer surface possesses the pattern of the cellular structure of the core. It will be appreciated that rollers of this type will have all the advantages of the heretofore described rollers having a soft core and a relatively hard skin, except that when the skin is so thick that there is no cellular structure on the outer surface, they will not provide the action due to the retention of air in the cellular structure on the surface of the skin.

By way of specific example, the roller 10 of FIG. 1 is approximately ¾ of an inch in diameter and is fabricated of open cell polyurethane foam having a density of about 2 pounds per cubic foot and it has about 60 pores per linear inch. The polyurethane coating is about 0.015 inches thick and is applied as shown in FIG. 9 and consists of the above-mentioned TRANCO polyurethane polymer liquid sold under the designation MC-245.

By way of further example, the roller of FIG. 7 is approximately 1¼ inches in diameter and is fabricated of open cell polyurethane foam having a density of about 4 pounds per cubic foot and it has about 100 pores per linear inch. The polyurethane coating is about 3/32 inches thick and is applied as shown in FIG. 9 and consists of the above-mentioned TRANCO polyurethane polymer liquid sold under the designation MC-245.

It will be appreciated that while the foregoing description referred to the skin as being polyurethane, other liquids may be applied as a skin and these could include polyvinyl chloride, neoprene, natural rubber, or any rubber-like elastic polymer which can be dissolved in a solvent which will evaporate, as was the case with the polyurethane liquid. The foregoing skins will preferably have a Durometer reading of between about 60 and 90, but the reading may be more or less than these values. If desired, the skin, after evaporation of the solvent, may have a thin hard shell which will only have a slight give to it. In addition, while the core has been described as having a specific range of both sizes and densities, it will be appreciated that the present invention may be practiced outside of these ranges.

While the foregoing description has referred to paper-feeding rollers, it will be appreciated that the rollers of the present invention may have utility in other applications, and accordingly certain claims are not limited to paper-feeding rollers.

While preferred embodiments of the present invention have been disclosed, it will be appreciated that the present invention is not limited thereto but may be otherwise embodied within the scope of the following claims.

What is claimed is:

1. A paper feeding roller for feeding paper comprising a core of soft resilient material, an annular skin of abrasion-resistant flexible material secured to said core, and an outer surface on said annular skin having depression means therein for causing said outer surface to have a tread for gripping said paper and feeding said paper when said paper is free to move and for accepting air for avoiding planing of said roller when said paper is being fed by said roller and for acting as a lubricant to permit slipping between said paper and said roller in the event said paper is held against movement and for receiving paper particles from said paper, said annular skin being capable of flexing with said core to conform to the surface of the paper against which it is pressed, and said annular skin returning to its original shape upon terminating contact with said paper for ejecting said paper particles from said depression means to thereby produce a self-cleaning action.

2. A paper feeding roller as set forth in claim 1 wherein said annular skin is coated onto said core.

3. A paper feeding roller as set forth in claim 1 wherein said core has a substantially zero Durometer reading.

4. A paper feeding roller as set forth in claim 1 wherein said core is formed of foamed resilient material having a cellular structure.

5. A paper feeding roller as set forth in claim 4 wherein said foamed resilient material is of open cell structure.

6. A paper feeding roller as set forth in claim 5 wherein said skin is coated onto said core and impregnates said open cell structure to interlock therewith.

7. A paper feeding roller as set forth in claim 6 wherein said depression means comprise the open cell contour of said core formed on the surface of said skin.

8. A paper feeding roller as set forth in claim 4 wherein said foamed resilient material is of closed cell structure.

9. A paper feeding roller as set forth in claim 1 wherein said depression means are of a size of between about 60 and 100 depressions per linear inch.

10. A paper feeding roller as set forth in claim 1 wherein said depression means are of a size of between about 10 and 100 depressions per linear inch.

11. A paper feeding roller as set forth in claim 3 wherein said depression means are of a size of between about 10 and 100 depressions per linear inch.

12. A paper feeding roller as set forth in claim 3 wherein said skin has a Durometer reading of between about 60 and 90.

13. A paper feeding roller as set forth in claim 12 wherein said depression means are of a size of between about 10 and 100 depressions per linear inch.

14. A paper feeding roller as set forth in claim 3 wherein said skin has a thickness of between about 0.005 inches and 3/32 inches.

15. A paper feeding roller as set forth in claim 14 wherein said skin has a Durometer reading of between about 60 and 90.

16. A paper feeding roller as set forth in claim 15 wherein said depression means are of a size of between about 10 and 100 depressions per linear inch.

17. A paper feeding roller as set forth in claim 10 wherein said skin has a Durometer reading of between about 60 and 90.

18. A paper feeding roller as set forth in claim 17 wherein said skin has a thickness of between about 0.005 inches and 3/32 inches.

* * * * *